US012209335B2

(12) United States Patent
Zhou et al.

(10) Patent No.: US 12,209,335 B2
(45) Date of Patent: Jan. 28, 2025

(54) WICKING STRUCTURE OF 3D-KNITTED SPACER FABRIC

(71) Applicant: HONEYWELL INTERNATIONAL INC., Charlotte, NC (US)

(72) Inventors: Tianqi Zhou, Charlotte, NC (US); Yuyan Wang, Charlotte, NC (US); Rui Luo, Charlotte, NC (US); Ling Lin, Charlotte, NC (US); Zheng Gu, Charlotte, NC (US); Peng Zhou, Charlotte, NC (US); Jing Xu, Charlotte, NC (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 18/480,243

(22) Filed: Oct. 3, 2023

(65) Prior Publication Data

US 2024/0125016 A1 Apr. 18, 2024

(30) Foreign Application Priority Data

Oct. 18, 2022 (CN) ..... 202211272069.0

(51) Int. Cl.
*D04B 1/12* (2006.01)
*D02G 3/02* (2006.01)
(Continued)

(52) U.S. Cl.
CPC ..... *D04B 1/12* (2013.01); *D02G 3/02* (2013.01); *D02G 3/36* (2013.01); *D04B 21/08* (2013.01);
(Continued)

(58) Field of Classification Search
CPC . D04B 1/12; D04B 1/16; D04B 21/12; D04B 21/16; D04B 21/08; D10B 2403/021; D10B 2401/022; D10B 2401/021
(Continued)

(56) References Cited

U.S. PATENT DOCUMENTS 459,866 A * 9/1891 Clewley ..... D04B 21/20 66/196
6,588,237 B2 * 7/2003 Cole ..... A43B 23/0255 66/201
(Continued)

FOREIGN PATENT DOCUMENTS

DE 10055902 A1 6/2001
DE 102020006022 A1 5/2022
(Continued)

OTHER PUBLICATIONS

Extended European Search Report Mailed on Mar. 1, 2024 for EP Application No. 23198433, 8 page(s).

*Primary Examiner* — Danny Worrell
(74) *Attorney, Agent, or Firm* — Alston & Bird LLP

(57) ABSTRACT

The invention provides 3D-knitted spacer fabrics of high breathability and moisture management and methods of making the 3D-knitted spacer fabrics. The middle layer of the fabric is made of hydrophilic material, comprising two yarns, a blended thermo-fuse wicking yarn comprising hydrophilic fiber and thermo-fuse fiber, and a non-supportive hydrophilic functional wicking yarn. The top layer of the fabric comprises a hydrophilic yarn, and the third layer of the fabric comprises a hydrophobic yarn. The 3D-knitted spacer fabrics are useful in clothing and equipment for wear in high temperature environments.

20 Claims, 6 Drawing Sheets

(51) Int. Cl.
*D02G 3/36* (2006.01)
*D04B 21/08* (2006.01)
*D06C 7/02* (2006.01)

(52) U.S. Cl.
CPC ..... *D06C 7/02* (2013.01); *D10B 2331/04* (2013.01); *D10B 2401/022* (2013.01); *D10B 2401/04* (2013.01); *D10B 2403/0114* (2013.01); *D10B 2403/021* (2013.01)

(58) Field of Classification Search
USPC ..... 66/195, 196, 202, 200, 193
See application file for complete search history.

(56) References Cited

U.S. PATENT DOCUMENTS

| | | | | |
|---|---|---|---|---|
| 6,755,052 | B1 * | 6/2004 | Sytz | D04B 1/18 66/196 |
| 6,779,369 | B2 * | 8/2004 | Shepherd | D04B 1/126 66/196 |
| 7,779,654 | B2 * | 8/2010 | Garus | D04B 1/24 66/196 |
| 11,015,271 | B2 | 5/2021 | Lawrence | |
| 11,155,943 | B2 * | 10/2021 | Dua | A43B 1/04 |
| 11,208,744 | B2 | 12/2021 | Urbelis | |
| 2019/0335831 | A1 | 11/2019 | Urbelis | |
| 2020/0115831 | A1 | 4/2020 | Tuscia et al. | |
| 2022/0115831 | A1 | 4/2022 | Chen et al. | |

FOREIGN PATENT DOCUMENTS

| | | | |
|---|---|---|---|
| EP | 0833000 | A1 | 4/1998 |
| EP | 3597808 | B1 | 9/2021 |
| JP | 2020-501039 | A | 1/2020 |
| JP | 7072708 | B1 | 5/2022 |
| WO | 2008/148126 | A2 | 12/2008 |
| WO | 2011/108954 | A1 | 9/2011 |
| WO | 2022069950 | A1 | 4/2022 |

* cited by examiner

15

21

22

WICKING STRUCTURE OF 3D-KNITTED SPACER FABRIC

CROSS-REFERENCE TO RELATED APPLICATIONS

This application claims priority pursuant to 35 U.S.C. 119(a) to Chinese Application No. 202211272069.0, filed Oct. 18, 2022, which application is incorporated herein by reference in its entirety.

BACKGROUND OF THE INVENTION 3D-knitted spacer fabrics are a class of knitted fabric having two face layers and a middle filler layer which connects the top and bottom face layers by spacer yarns that run between the top and bottom face layers. Middle layers are typically made of supportive hydrophobic or even water-repellant yarns to allow the fabric to form a 3D shape. However, such fabrics have poor moisture management due to poor liquid absorbing, transferring, and drying properties.

Reported in the art are fabrics with middle layers comprising yarns of various materials. U.S. Pat. No. 11,208,744 reports a fabric with a middle layer of monofilament or multifilament texturized yarns, for example impact absorbing elastic texturized polyester (PES), polyamide (PA) yarns or PES or PA yarns with elastane or Spandex. WO 2022069950A1 reports a method to increase the moisture management property of 3D-knitted fabrics by using both a thermo-fuse yarn and a hydrophobic supportive yarn for the transverse threads of the middle layer with inlays of hydrophilic yarn connected only to the middle layer transverse threads. US20220115831A1 reports a fabric with a middle layer of a hydrophilic fusible yarn for moisture management. JP7072708B1 reports a fabric with a middle layer of a hydrophilic fiber and heat-fusible fiber or a middle layer of hydrophilic fiber and heat-fusible fiber and a hydrophobic fiber. EP3597808B1 reports a fabric with a middle layer of a hydrophilic thermoplastic fiber or a hydrophobic thermoplastic fiber subjected to a hydrophilic treatment. There is a need in the art for 3D-knitted spacer fabrics with improved moisture management properties.

BRIEF SUMMARY OF THE CLAIMED INVENTION

In one aspect, the invention provides a three-dimensional (3D)-knitted spacer fabric, the 3D-knitted spacer fabric comprising a top layer, a bottom layer, and an intermediate layer, wherein the top layer and the bottom layer are joined together by cross-yarns constituting the intermediate layer, wherein the intermediate layer comprises a first yarn and a second yarn, wherein the first yarn is a first hydrophilic yarn and the second yarn is a blended heat-fusible yarn, comprising a hydrophilic fiber and a heat-fusible fiber. In some 3D-knitted spacer fabrics, the top layer comprises a second hydrophilic yarn. In some 3D-knitted spacer fabrics, the bottom layer comprises a hydrophobic yarn.

Some 3D-knitted spacer fabrics are warp-knitted 3D-knitted spacer fabrics. Some warp-knitted 3D-knitted spacer fabrics are knitted on a double-bed warp knitting machine.

Some 3D-knitted spacer fabrics are weft-knitted 3D-knitted spacer fabrics. Some weft-knitted 3D-knitted spacer fabrics are knitted on a double-bed weft knitting machine. Some weft-knitted 3D-knitted spacer fabrics are knitted on a circular double-bed weft knitting machine. Some weft-knitted 3D-knitted spacer fabrics are knitted on a flat double-bed weft knitting machine. In some 3D-knitted spacer fabrics, the blended heat-fusible yarn is fused by heat treatment to impart a 3D shape to the 3D-knitted spacer fabric.

In some 3D-knitted spacer fabrics, the heat fusible fiber in the blended heat-fusible yarn is low-melting-point viscose, nylon, or polyester. In some 3D-knitted spacer fabrics, the hydrophilic fiber in the blended heat-fusible yarn is a natural fiber, a synthetic fiber, or an artificial fiber. For example, the natural fiber can be cotton or wool. For example, the synthetic fiber can be nylon or modified polyester. For example, the artificial fiber can be viscose. In some 3D-knitted spacer fabrics, the blended heat-fusible yarn comprises a core layer of hydrophilic polyester and a shell layer of thermo-fuse polyester.

For example, the natural fiber can be cotton or wool. For example, the synthetic fiber can be nylon or modified polyester. For example, the artificial fiber can be viscose.

In some 3D-knitted spacer fabrics, the second hydrophilic yarn is a natural fiber, a synthetic fiber, or an artificial fiber. For example, the natural fiber can be cotton or wool. For example, the synthetic fiber can be nylon or modified polyester. For example, the artificial fiber can be viscose.

In some 3D-knitted spacer fabrics, the hydrophobic yarn is a monofilament yarn or a multifilament yarn. For example, the monofilament yarn can be polyethylene terephthalate (PET), thermoplastic polyether ester elastomer (TPEE), polyamine (PA), thermoplastic polyurethane (TPU), polypropylene (PP), or polyethylene (PE). For example, the multifilament yarn can be polyester, polyethylene, or polypropylene.

In some 3D-knitted spacer fabrics, the second hydrophilic yarn is polyester; the first hydrophilic yarn is polyester, the blended heat-fusible yarn comprises a core layer of hydrophilic polyester and a shell layer of thermo-fuse polyester, and the hydrophobic yarn is PET monofilament.

In another aspect, the invention provides a method for manufacturing a three-dimensional (3D)-knitted spacer fabric, the 3D knitted spacer fabric being manufactured on a double-bed knitting machine, wherein the method comprises simultaneously knitting a top layer, a bottom layer and an intermediate layer for providing a connection between the top layer and the bottom layer, the intermediate layer comprising cross-yarn configured for providing a resilient connection between the top layer and the bottom layer, wherein the intermediate layer is knitted from a first yarn and a second yarn, wherein the first yarn is a first hydrophilic yarn and the second yarn is a blended heat-fusible yarn, comprising a hydrophilic fiber and a heat-fusible fiber. In some methods, the top layer is knitted from a second hydrophilic yarn. In some methods, the bottom layer is knitted from a hydrophobic yarn.

In some methods, the 3D-knitted spacer fabric is a warp knitted 3D-knitted spacer fabric. In some methods, the double-bed knitting machine is a double-bed warp knitting machine.

In some methods, the 3D-knitted spacer fabric is a weft-knitted 3D-knitted spacer fabric. In some methods, the double-bed knitting machine is a double-bed weft knitting machine. In some methods, the double-bed weft knitting machine is a circular double-bed weft knitting machine. In some methods, the double-bed weft knitting machine is a flat double-bed weft knitting machine.

Some methods further comprise heating the 3D-knitted spacer fabric, setting the heated 3D-knitted spacer fabric to a 3D shape, and cooling the set 3D-knitted spacer fabric to impart the 3D shape to the 3D-knitted spacer fabric.

In some methods, the heat fusible fiber in the blended heat-fusible yarn is low-melting-point viscose, nylon, or polyester. In some methods, the hydrophilic fiber in the blended heat-fusible yarn is a natural fiber, a synthetic fiber, or an artificial fiber. For example, the natural fiber can be cotton or wool. For example, the synthetic fiber can be nylon or modified polyester. For example, the artificial fiber can be viscose. In some methods, the blended heat-fusible yarn comprises a core layer of hydrophilic polyester and a shell layer of thermo-fuse polyester.

In some methods, the first hydrophilic yarn is a natural fiber, synthetic fiber, or an artificial fiber. For example, the natural fiber can be cotton or wool. For example, the synthetic fiber can be nylon or modified polyester. For example, the artificial fiber can be viscose.

In some methods, the second hydrophilic yarn is a natural fiber, a synthetic fiber, or an artificial fiber. For example, the natural fiber can be cotton or wool. For example, the synthetic fiber can be nylon or modified polyester. For example, the artificial fiber can be viscose.

In some methods, the hydrophobic yarn is a monofilament yarn or a multifilament yarn. For example, the monofilament yarn can be polyethylene terephthalate (PET), thermoplastic polyether ester elastomer (TPEE), polyamine (PA), thermoplastic polyurethane (TPU), polypropylene (PP), or polyethylene (PE). For example, the multifilament yarn can be polyester, polyethylene, or polypropylene.

In some methods, the second hydrophilic yarn is polyester; the first hydrophilic yarn is polyester, the blended heat-fusible yarn comprises a core layer of hydrophilic polyester and a shell layer of thermo-fuse polyester, and the hydrophobic yarn is PET monofilament.

In another aspect, the invention provides an article of manufacture comprising any of the 3D-knitted spacer fabrics disclosed herein. For example, the article of manufacture can be an item of clothing. For example, the item of clothing can be a kneepad, an elbow pad, or a shoe. For example, the article of manufacture can be an item of furniture. For example, the item of furniture can be a cushion, mattress, pillow, or table mat. For example, the article of manufacture can be a base fabric in a surgical dressing. For example, the item of clothing can be a safety harness. The safety harness can comprise a padding. The padding can comprise any of the 3D-knitted spacer fabrics disclosed herein.

In another aspect, the invention provides a method for absorbing sweat using any of the 3D-knitted spacer fabrics disclosed herein.

BRIEF DESCRIPTION OF THE DRAWINGS

FIG. 1C is a close-up view of the second and third layers of an exemplary weft-knitted 3D-knitted spacer fabric, looking down from the first (top) layer onto the second and third layers. In 1C, a first yarn of the second (middle) layer is marked with right-leaning wide line hatching (22), a second yarn of the second (middle) layer is marked with left-leaning narrow line hatching (21), and a yarn of the third (bottom) layer is marked with left-leaning medium-width line hatching (31).

In FIG. 2A, depicted are back needle bed (4); front needle bed (5); and six guide bars of the double-bed warp-knitting machine (6). Bars are numbered from left to right as 61, 62, 63, 64, 65, and 66. Bars 61 and 62 are depicted as threaded with yarn marked with left-leaning medium-width line hatching (31), and bars 65 and 66 are depicted as threaded with yarn marked with right-leaning medium-width line hatching (11). Bars 63 and 64 knit the middle layer (middle layer bars). Bar 63 is depicted as threaded with yarn marked with no hatching (22), and bar 64 is depicted as threaded with yarn marked with left-leaning narrow line hatching (21). In 2A, the first (top) layer of fabric is marked with right-leaning medium-width line hatching (1), the second (intermediate, middle) layer depicted as (2), the third (bottom) layer of fabric is depicted marked with left-leaning medium-width line hatching (3), a first yarn of the second (middle) layer of fabric is marked with no hatching (22), a second yarn of the second (middle) layer of fabric is marked with left-leaning narrow line hatching (21). In FIG. 2B, depicted are second needle bed (7); first needle bed (8); and middle layer guide bar (9). In 2B, top and bottom face layers of fabric are marked as (10), the second (intermediate, middle) layer is marked as (2), a first yarn of the second (middle) layer of fabric is marked with no hatching (22), a second yarn of the second (middle) layer of fabric is marked with left-leaning narrow line hatching (21). Middle layer guide bar (9) is threaded with both the first (22) and second (21) yarns of the middle layer. FIG. 2C depicts the process for heat treating an exemplary 3D-knitted spacer fabric prepared by the process of FIG. 2A or 2B. FIG. 2C depicts a cross-section of an exemplary 3D-knitted spacer fabric prepared by the process of FIG. 2A or 2B before (FIG. 2C.1) and after (FIG. 2C.2) heat treatment. In 2C.1, and 2C.2, the first (top) layer of fabric is marked as (1), the second (intermediate, middle) layer marked as (2), and the third (bottom) layer of fabric is marked as (3), a first yarn of the second (middle) layer of fabric is marked with no hatching (22), a second yarn of the second (middle) layer of fabric is marked with left-leaning narrow line hatching (21).

DEFINITIONS

Figure 1A:
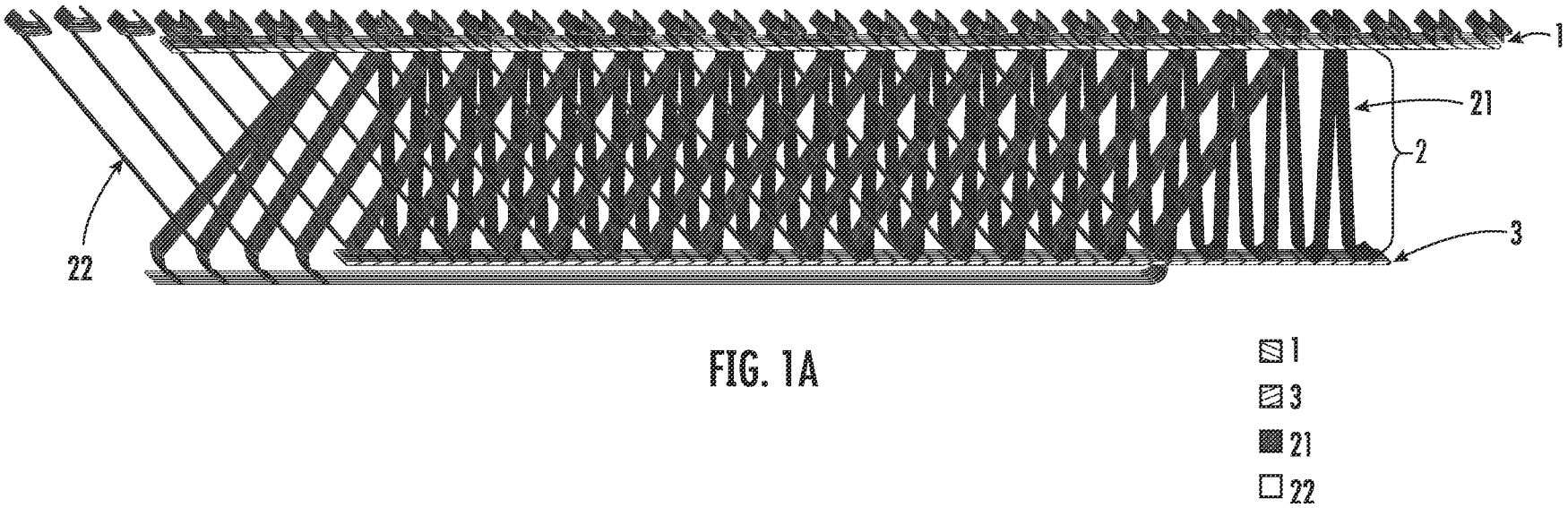
FIGS. 1A, 1B, and 1C depict structures of exemplary 3D-knitted spacer fabrics:warp-knitted (1A) and weft-knitted (1B and 1C). In both 1A and 1B, the first (top) layer is marked with right-leaning medium-width line hatching (1), the second (intermediate, middle) layer marked as (2), and the third (bottom) layer is marked with left-leaning medium-width-line hatching (3), a first yarn of the second (middle) layer is marked with no hatching (22), a second yarn of the second (middle) layer is marked with left-leaning narrow line hatching (21).

The term "warp knitted" refers to a fabric produced by machine with the yarns running in a lengthwise direction. Warp knitting is the sequential formation and interlinking of loops in an axial direction on a lateral array of needles with at least one separate thread being supplied to each needle. The loops are joined together in a width-wise direction by moving the threads back and forth between adjacent needles. The needles produce parallel rows of loops simultaneously that are interlocked in a zigzag pattern.

The term "weft-knitted" refers to a knit fabric produced in machine or hand knitting with the yarns running, crosswise across the width of the fabric or in a circle.

A "hydrophilic yarn" refers to a yarn that absorbs liquids and moisture.

A "hydrophobic yarn" refers to a yarn that resists liquids and moisture penetration.

"Heat-fusible" or "thermo-fuse" fibers or yarns refer to fibers and yarns that under the effects of heat (e.g., steam, hot air, infrared rays) will melt and then, after/during cooling, recrystallize, becoming solid. The term "blended thermo-fuse wicking yarn" refers to a yarn comprising hydrophilic fiber and thermo-fuse fiber.

The term "functional yarn" refers to a type of yarn that combines mechanical and functional properties, for example a yarn that has the functional property of wicking fluids. The term "functional wicking yarn" refers to a yarn that has the functional property of wicking fluids.

The term "moisture-manageable yarn" refers to a yarn that has the property of absorbing and/or wicking fluids and/or the property of drying. The term "property of drying" refers to the drying rate (g/h) for a fabric to evaporate 0.2 ml liquid water, for example using standard AATCC TM201 or AATCC TM201 to test. Depending on the purpose of moisture management, the requirement for drying speed may vary. A moisture-manageable yarn as used herein has a fast-drying property, of ≥0.18 g/h according to GB21655.1.

The term "supportive yarn" refers to a yarn having a certain elasticity of compression and a certain resilience along the length direction of the yarn. A supportive yarn is rigid enough to withstand a certain force or compressive pressure. A supportive yarn withstands load and recover to the original shape automatically when the force is removed. In a 3D-knittted spacer fabric, the supportive yarn in the middle layer can maintain the distance between top and bottom surfaces when there is no load on it and recover to the original shape when the force is removed. Exemplary supportive yarns are polyethylene terephthalate (PET) monofilament, polyethylene (PE) monofilament, or thermoplastic polyester elastomer (TPEE) monofilament. Some supportive yarns can withstand load. Ability to withstand load, depends, for example, on material type of the yarn, fineness of the yarn, and/or knitting structure of the middle layer. For example, the thicker the yarn and the more serried the middle layer, the stronger the support. The larger the amount of yarn knitted in a unit area of the middle layer, the stronger the support.

The term "non-supportive yarn" refers to a yarn without elasticity of compression and without resilience along the length direction of the yarn. A non-supportive yarn is too soft to withstand load and cannot recover to the original shape automatically when the force is removed. Exemplary non-supportive yarns are cotton yarn, silk yarn, polyester multifilament yarn.

The term "wicking" refers to the action of absorbing or drawing off liquid by capillary action. The term "wicking yarn" refers to a yarn that absorbs or draws off liquid by capillary action.

The term "synthetic fiber" refers to a fiber commonly created through the indirect synthesis of petroleum derivatives. Exemplary synthetic fibers are nylon and polyester.

The term "artificial fiber" (also known as "semi-synthetic fiber") refers to a fiber such as rayon that is generally derived from natural material, through chemical processes. Exemplary artificial fibers are viscose, Tencel, and Modal.

The term "modified polyester" refers to a polyester modified to be hydrophilic. Polyester is originally hydrophobic. For example, polyester may be modified to be made hydrophilic by the following two methods:

1) create a non-circular cross-section of the filament in spinning process to increase wicking properties; or
2) attach a hydrophilic functional group to polyester molecule.

Compositions or methods "comprising" or "including" one or more recited elements may include other elements not specifically recited. When the disclosure refers to a feature comprising specified elements, the disclosure should alternatively be understood as referring to the feature consisting essentially of or consisting of the specified elements.

Designation of a range of values includes all integers within or defining the range, and all subranges defined by integers within the range.

Unless otherwise apparent from the context, the term "about" encompasses insubstantial variations, such as values within a standard margin of error of measurement (e.g., SEM) of a stated value.

Statistical significance means $p \leq 0.05$.

The singular forms of the articles "a," "an," and "the" include plural references unless the context clearly dictates otherwise.

DETAILED DESCRIPTION

1. General

The invention provides 3D-knitted spacer fabric compositions with properties of moisture management, compression, and rebound resistance and methods of making the compositions. The 3D-knitted spacer fabric compositions comprise three layers, a first (top) layer, a second (middle or intermediate) layer, and a third (bottom) layer. The first (top) layer comprises a hydrophilic yarn and is closest to the skin of the wearer. All material(s) used in the middle layer is (are) hydrophilic and are non-supportive functional wicking yarn. No hydrophobic yarn is used. The second layer comprises a first yarn and a second yarn, each of which is hydrophilic. The first yarn of the second layer is a hydrophilic yarn, and the second yarn of the second layer is a blended heat-fusible yarn, comprising hydrophilic fiber and heat-fusible fiber. The third (bottom) layer comprises a hydrophobic yarn and is farthest from the skin of the wearer. The hydrophilic middle layer provides improved liquid transfer from the top layer to the bottom layer of the compositions. The 3D-knitted fabrics may be warp-knitted or weft-knitted. Heat treatment of the 3D-knitted spacer fabric compositions solidifies the heat-fusible yarn of the middle layer, allowing the fabric to be set to a desired shape and providing compression and rebound resistance, and maintaining the moisture management and wicking properties after heat treatment.

Figure 1B:
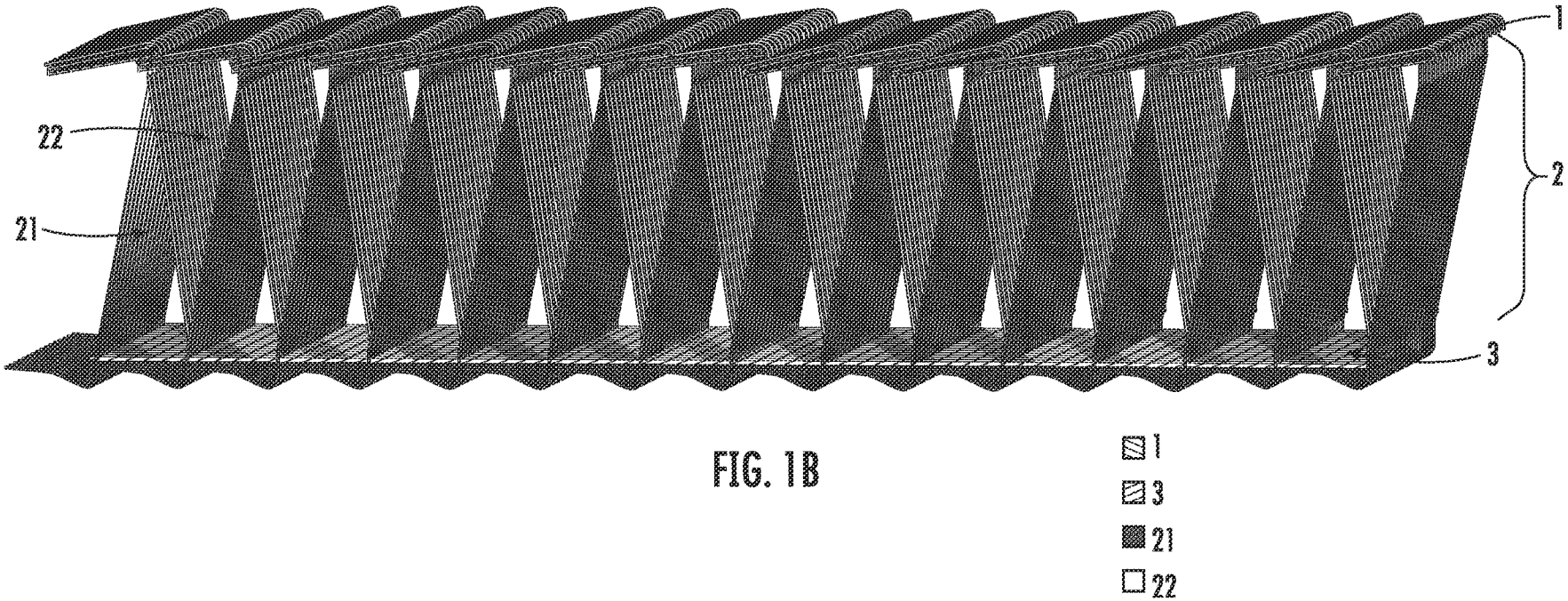
Figure 1C:
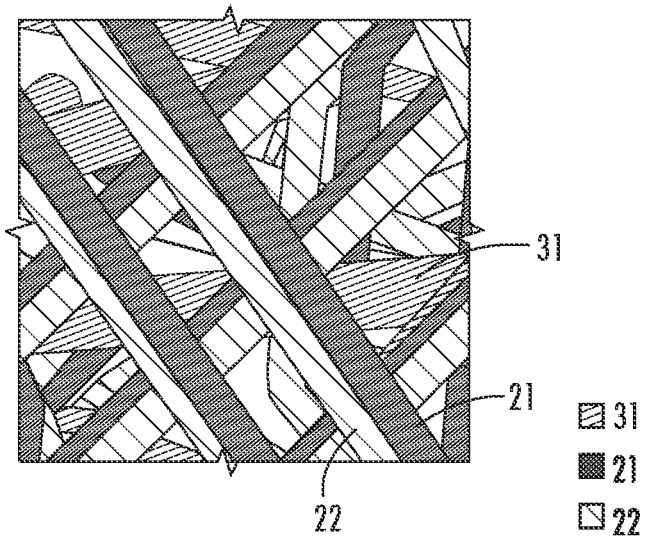

This invention provides a knitting structure for the middle layer of the spacer fabric, connected to top and bottom surfaces. The structure of the middle layer has wicking properties. In an exemplary warp-knitting process, one bar of yarn (on middle bar 64 in FIG. 2A) is blended thermo-fuse wicking yarn (21 on FIG. 2A), made of hydrophilic fiber and thermo-fuse fiber; The other bar of yarn (on middle bar 63 in FIG. 2A) is non-supportive hydrophilic functional wicking yarn (22 on FIG. 2A). In exemplary weft-knitting process, a middle guide bar (9 in FIG. 2B) is threaded with two yarns, a first yarn that is a blended thermo-fuse wicking yarn (22 on FIG. 2B), made of hydrophilic fiber and thermo-fuse fiber; and a second yarn that is a non-supportive hydrophilic functional wicking yarn (21 on FIG. 2B). The top layer of the fabric is knit from a hydrophilic yarn and the bottom layer is knit from a hydrophobic yarn in order to increase one-direction moisture transfer property of the 3D-knitted spacer fabric. A top layer of the fabric is put next to a wet subject when in use, and liquid will be absorbed and transfer to the bottom surface layer through the yarn of the middle layer. The bottom hydrophobic yarn promotes fast drying. An exemplary warp-knitted fabric of the invention is depicted in FIG. 1A. An exemplary weft-knitted fabric of the invention is depicted in FIG. 1B. FIG. 1C depicts a close-up view of the second and third layers of an exemplary weft-knitted 3D-knitted spacer fabric, looking down from the first (top) layer onto the second and third layers.

2. 3D-Knitted Spacer Fabrics

Three-dimensional (3D)-knitted spacer fabrics are knit on a double-bed knitting machine and may be warp-knitted or weft-knitted. Both warp-knitted and weft knitted 3D spacer fabrics consist of two face layers (a top layer and a bottom layer) and a middle filler layer (intermediate layer, second layer). The top layer and the bottom layer are joined together by cross-yarns constituting the intermediate layer.

To form a 3D shape, the filler material is required to be supportive. Therefore, filler materials for traditional 3D-knitted spacer fabrics are usually resilient hydrophobic monofilament such as polyethylene terephthalate (PET), thermoplastic polyether ester elastomer (TPEE), polyamine (PA), thermoplastic polyurethane (TPU), or polypropylene (PP), knitted with designed angles between the two face layers, which are knitted from hydrophobic or even water-repellent material. The thickness of an exemplary traditional 3D-knitted spacer fabric is thicker than that of three normal-knitted single fabric layers piled together, in the case of using same yarns for each layer. An exemplary traditional 3D-knitted spacer fabric has thickness larger than 3 mm. Functional yarns, such as hydrophilic or moisture manageable yarns, are not used in the filler layer of traditional 3D-knitted spacer fabrics because functional yarns are usually non-supportive and cannot form a 3D shape with the thickness of a traditional 3D-knitted spacer fabric. Therefore, there is little liquid transfer from one face surface to the other face surface through the middle layer perpendicularly, resulting in poor liquid absorbing, transferring, and drying properties of a traditional 3D-knitted spacer fabric.

In a traditional 3D-knitted spacer fabric, both face layers are knitted with same material as each other. For a traditional 3D-knitted spacer fabric, the two surface layers could be both hydrophobic materials, for example, bouncy hydrophobic monofilament such as PA, TPU, PET, TPEE, or PP; or could both be hydrophilic materials, for example, natural yarn, synthetic yarn, artificial yarn, such as cotton, wool, viscous, multifilament nylon, or polyester.

3D-knitted spacer fabrics may be knitted with a range of hole patterns, for example a small-hole pattern, a medium-hole pattern, or a large-hole pattern. In a small-hole pattern, the diameter of the hole is not larger than about twice the width of a knitted loop, or less than about 3 mm. In a medium-hole pattern, the diameter of the hole is about 3 mm to 6 mm. In a large-hole pattern, the diameter of the hole is larger than about 6 mm. A traditional 3D-knitted spacer fabric is knitted with a small-hole pattern on the two surface layers.

Figure 3A:
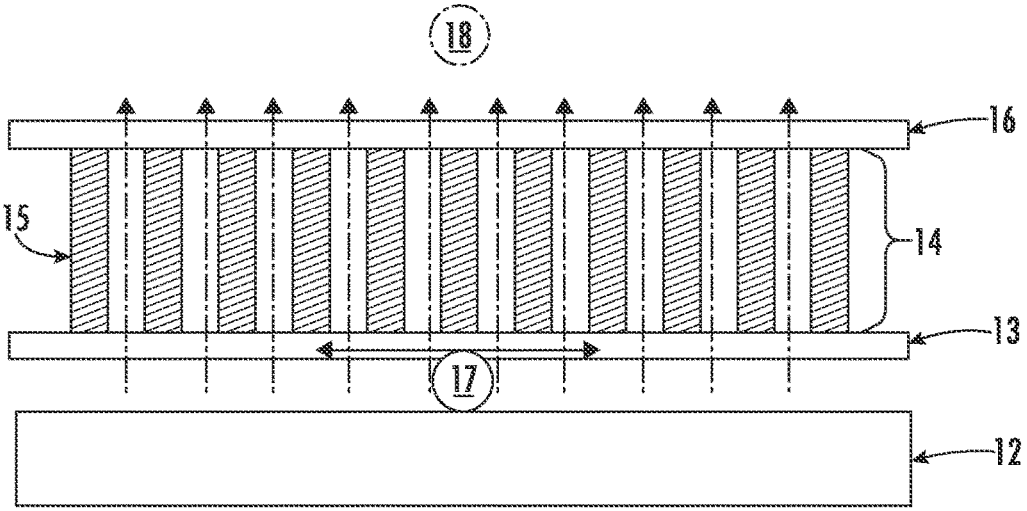
FIGS. 3A and 3B depict moisture transfer of a traditional 3D-knitted spacer fabric (3A) and an exemplary 3D-knitted spacer fabric according to the invention (3B). In 3A; depicted are skin, for example skin of a human (12), the first layer of fabric (closest to skin) is marked as (13), the second (middle, intermediate) layer is marked as (14), a hydrophobic yarn of a second (middle, intermediate) layer is marked with left-leaning medium-width line hatching (15), and the third (farthest from skin) layer of fabric is marked as (16). Liquid water (sweat) is depicted as solid-line circle marked as (17), and direction of movement of sweat is depicted by a solid-line horizontal double-headed arrow. Water vapor is depicted as a broken line circle (18) and direction of movement of water vapor through the first, second, and third layers is depicted by short-long dashed-line arrows. In 3B, depicted are skin, for example skin of a human (12), the first layer of fabric (closest to skin) is marked as (1), the second (middle, intermediate) layer is marked as (2), the third layer of fabric (farthest from skin) is marked as (3), a first yarn of the second (middle) layer of fabric is marked with left-leaning wide line hatching (22), a second yarn of the second (middle) layer of fabric is marked with left-leaning narrow line hatching (21). Liquid water (sweat) is depicted as a solid-line circle marked as (17), and direction of movement of sweat is depicted by solid-line arrows along the first layer of fabric closest to skin (solid-line horizontal double-headed arrow) and along the first (22) and second (21) yarns of the second layer through the third layer (solid-line vertical arrows), where it is evaporated at the outer surface of the third layer (dashed line wavy arrows). Water vapor is depicted as a broken line circle (18) and direction of movement of water vapor through the first, second, and third layers is depicted by short-long dashed arrows.

FIG. 3A depicts a schematic showing moisture management properties of a traditional 3D knitted spacer fabric which has a middle layer (14) of hydrophobic yarn (15), and which has a first layer (13) and a third layer (16) both knitted of same material as each other. Although the traditional 3D-knitted spacer fabric has good breathability, liquid water (sweat) (17) stays between the skin (12) and the first layer (13, layer closest to skin), depicted in FIG. 3A as a solid-line horizontal double-headed arrow. Evaporation of water through the hydrophobic middle layer (14) and the third (16) layer is shown as short-long dashed-line vertical arrows in FIG. 3A, with water vapor depicted as (18), however evaporation through the fabric is relatively slow. Liquid water is not transferrable through the middle layer of supportive hydrophobic yarn.

A traditional 3D-knitted spacer fabric has poor liquid moisture management property. Methods of increasing liquid moisture management properties in 3D-knitted spacer fabric have been reported, but have disadvantages.

Moisture management properties of 3D-knitted spacer fabrics may be increased by treating the fabric with hydrophilic agent auxiliaries (for example, "SOFTENER SR" from TAKAMATSU OIL & FAT CO., LTD). This method helps with moisture absorbing of the face layers made of multifilament yarns. However, the method requires high craft quantity, the yarn modulus will decrease after treatment, and it doesn't add any liquid transfer property between two face layers through middle layer perpendicularly.

U.S. Pat. No. 11,015,271 B2 reports a method to increase the moisture management property of 3D-knitted spacer fabrics by using covered or twisted yarn to replace the filler monofilament. The covered or twisted yarn has a core-shell structure. The core is a supportive monofilament, and the shell is a moisture manageable yarn. Although this method increases liquid transfer property between two face layers through middle layer perpendicularly, it requires a complicated, time-consuming, and cost-consuming yarn preparation process. Also, the covered yarn is hard to knit on a production machine.

DE10055902A1 reports a method to increase the moisture management property of 3D-knitted spacer fabrics by using both a hydrophilic yarn and a hydrophobic supportive yarn in a middle layer. The amount of yarn in fabric has a limit, and in this fabric, parts of the supportive yarns are replaced with non-supportive hydrophilic yarns. Therefore, this fabric loses support compared to a traditional 3D-knitted spacer fabric.

WO 2022069950A1 reports a method to increase the moisture management property of 3D-knitted spacer fabrics by using both a thermo-fuse yarn and a hydrophobic supportive yarn in middle layer for the transverse threads of the middle layer with inlays of hydrophilic yarn connected only to the middle layer transverse threads. This structure is complicated with three different yarn systems in the middle layer and costs more to produce than a traditional 3D-knitted spacer fabric.

3. 3D-Knitted Spacer Fabric of the Invention

The invention modifies a 3D-knitted spacer fabric for improved moisture management, compression, and rebound resistance properties by providing a middle layer comprising all hydrophilic fiber. No hydrophobic yarn is used in the middle layer. Liquid can transfer from top surface to the bottom surface of the fabric through all the yarns in the middle layer.

The fabric comprises a top surface layer (in contact with skin, for example skin of a human), a middle layer and a bottom layer. Liquid sweat is absorbed by the yarn in the top face layer (next to skin) and be wicked through the moisture management yarn in the middle layer to the bottom face layer, which increases the liquid spreading area and accelerates sweat evaporation.

The top layer comprises hydrophilic yarn/moisture manageable yarn. The middle layer comprises at least two hydrophilic yarns. An exemplary middle layer comprises two hydrophilic yarns. The first yarn in the middle layer is a hydrophilic yarn, and the second yarn in the middle layer is a blended heat-fusible yarn, comprising hydrophilic fiber and heat-fusible fiber. The hydrophilic yarn and the hydrophilic fiber in the blended heat-fusible yarn provide moisture management property to the fabric and the thermo-fuse fiber in the blended heat-fusible yarn provides support to a 3D shape of the fabric. The bottom surface layer comprises hydrophobic yarn.

Both surface layers are designed as medium hole patterns. Compared to traditional 3D spacer which are knitted as small-hole patterns, medium holes increase breathability and air permeability, and maintain sufficient support. Breathability of a medium-hole fabric may be better than that of a small-hole fabric because more area is empty in the medium-hole fabric, and more vapor moisture can spread out through the holes. Wicking property of a medium-hole fabric may be better than that of a large-hole fabric because more middle-layer yarns are available, and more liquid moisture can transfer to the outside through middle-layer wicking yarns. A medium-hole pattern provides improved balance between breathability and wicking property and provides both vapor and liquid moisture management, compared to small-hole patterns and large-hole patterns.

Both the blended thermo-fuse wicking yarn and the hydrophilic yarn in the middle layer are originally non-supportive and do not form a 3D shape in the knitting process. Heat treatment of the fabric after knitting melts and re-crystallizes the thermo-fuse fiber in the blended thermo-fuse yarn of the middle layer, allowing the fabric to be set to a desired 3D shape. The 3D-knitted spacer fabric of the invention provides support without comprising hydrophobic yarn.

4. Moisture Management Properties of 3D-Knitted Spacer Fabric of the Invention 3D knitted spacer fabrics of the invention provide improved moisture management properties over traditional 3D knitted spacer fabrics.

Evaporating sweat away from skin, for example skin of a human, through fabric may proceed by two processes:

(1) Liquid sweat evaporates directly from skin to the outside air through holes in the fabric. In this process, the higher the porosity of the fabric, the better the breathability of the fabric.

(2) Liquid sweat is absorbed and spread by the fabric and evaporates from the fabric surface to the air. In this process, the higher the wicking rate of the fabric, the larger the surface area spread by the liquid moisture. The larger surface area spread by the liquid moisture, the more moisture is exposed to the air. The more moisture exposed to the air, the faster the moisture can evaporate from the fabric and the better the breathability of the fabric.

The 3D-knitted spacer fabrics of the invention have a hydrophilic middle layer, and provide improved moisture transfer through the middle layer wicking yarn. The improved moisture transfer increases the effect of the second process of evaporation.

Figure 3B:
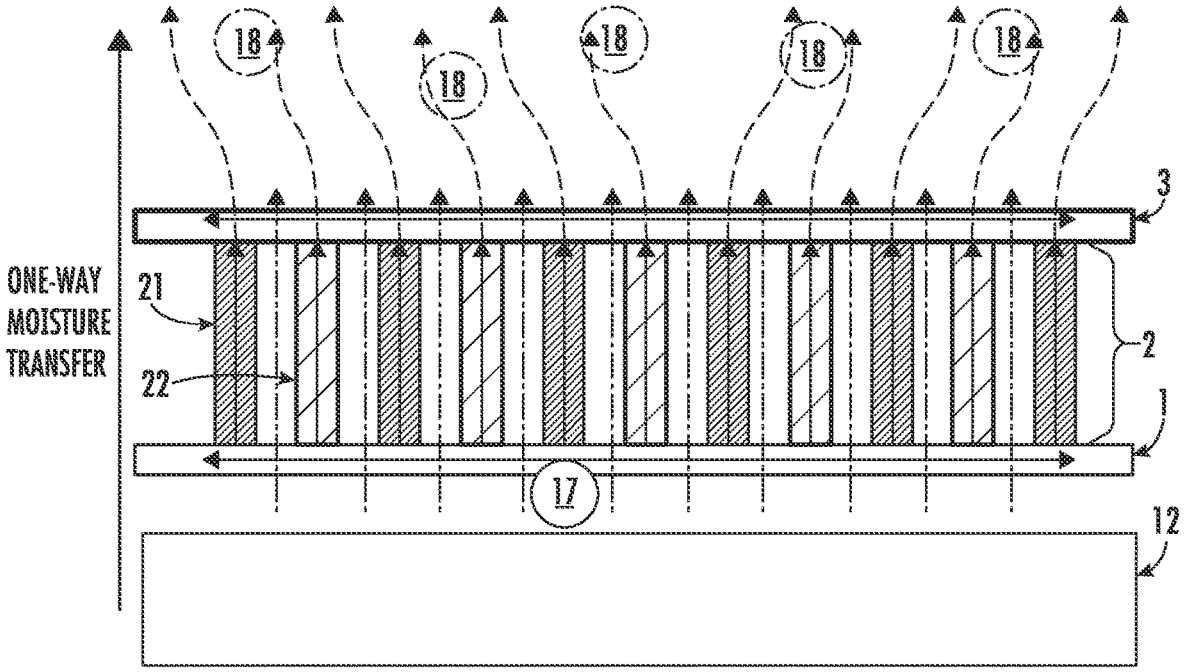

3D knitted spacer fabrics of the invention provide improved thermal comfort, good breathability, and fast absorbing of liquid water, making a wearer's skin dry fast. FIG. 3B depicts a schematic showing moisture management properties of 3D knitted spacer fabrics of the invention. Liquid (17) can transfer along both the blended thermo-fuse wicking yarn (21) and the non-supportive hydrophilic functional wicking yarn (22) from the first (closest to skin) layer (1) to the third layer (3), water transfer shown in FIG. 3B as vertical solid-line arrows on the yarns of the middle layer marked with left-leaning narrow line hatching (21) and yarns of the middle layer marked with left-leaning wide line hatching (22), which is then evaporated (water vapor shown as 18) as the liquid goes through the third layer (3). Therefore, the fabric has extremely fast spreading of liquid water, increases the area for evaporation, and better cools down a person wearing the fabric.

This invention provides perpendicular liquid moisture management properties, including fast absorbing and fast drying. Compared to a traditional 3D-knitted spacer fabric and alternative methods of as in Section 2, the 3D-knitted spacer fabric of the invention provides improved perpendicular moisture management property. This property will make the wearer feel dry and cool much faster than existing techniques as in Section 2, increasing human thermal comfort.

Figure 2A:
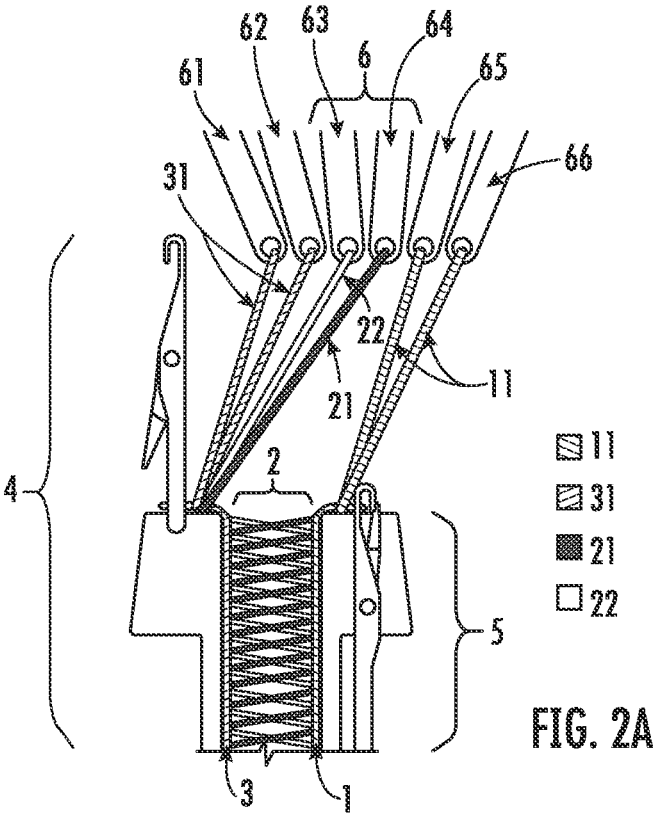
FIGS. 2A, 2B, and 2C depict processes for preparing exemplary 3D-knitted spacer fabrics: warp-knitted (2A) and weft-knitted (2B).

5. Methods of Preparing the 3D-Knitted Spacer Fabric 3D knitted spacer fabrics of the invention may be warp-knitted or weft-knitted. Warp knitted fabrics may be knitted for example on a double-bed warp knitting machine, e.g., a Karl Mayer (China) Ltd., Model No. HD6/20-35. FIG. 2A depicts an exemplary process for manufacturing a warp-knitted 3D knitted spacer fabric. For example, in a double-bed warp knitting machine with two middle layer bars (6), the left-most middle bar (63) is threaded with non-supportive hydrophilic functional wicking yarn and the right-most middle bar (64) is threaded with blended thermo-fuse wicking yarn, made of hydrophilic fiber and thermo-fuse fiber. In FIG. 2A, for purposes of illustration, the front needle bed (5) is depicted as making the top (first) layer (1) of the warp-knitted 3D-knitted spacer fabric of the invention, and the back needle bed (4) is depicted as making the bottom (third) layer (3) of the warp-knitted 3D-knitted spacer fabric of the invention. The invention also includes processes where the back needle bed (5) makes the top (first) layer of the warp-knitted 3D-knitted spacer fabric of the invention, and the front needle bed (4) makes the bottom (third) layer of the warp-knitted 3D-knitted spacer fabric of the invention.

Figure 2B:
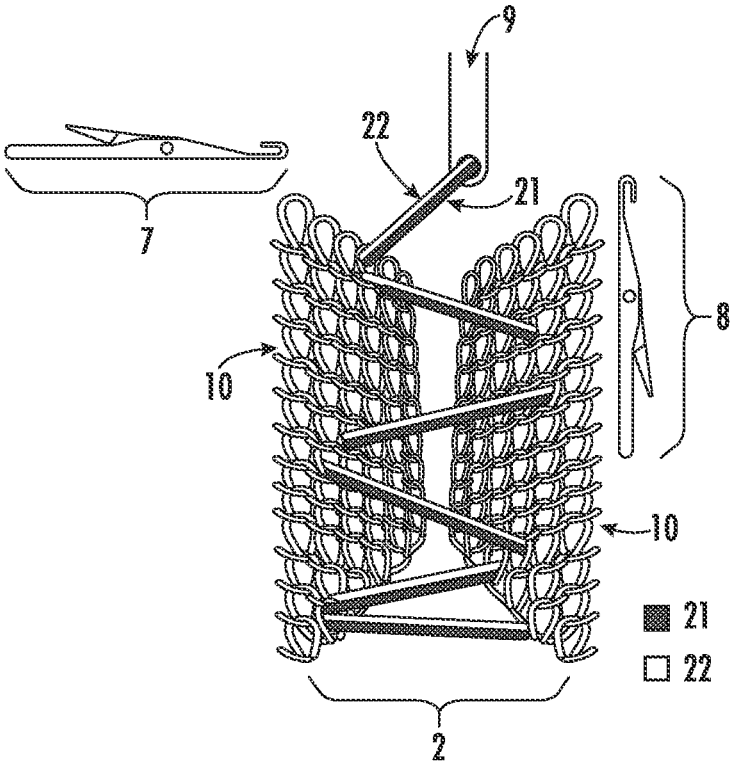

Weft knitted fabrics may be knitted flat or circular. Weft knitted fabrics may be knitted for example on a double-bed weft knitting machine e.g., a Stoll Machine (China) Co., CMS 350. Weft knitted fabrics may be knitted for example on a double-bed flat weft knitting machine or on a double-bed circular weft knitting machine. FIG. 2B depicts an exemplary process for manufacturing a weft-knitted 3D knitted spacer fabric. Middle layer guide bar (9) is threaded with a blended thermo-fuse wicking yarn (21), made of hydrophilic fiber and thermo-fuse fiber; and a non-supportive hydrophilic functional wicking yarn (22). In FIG. 2B, the top and bottom layers are each marked as (10). The invention includes a process where the first needle bed makes the top (first) layer of the weft-knitted 3D-knitted spacer fabric of the invention and the second needle bed makes the bottom (third) layer of the weft-knitted 3D-knitted spacer fabric of the invention. The invention includes a process where the second needle bed makes the top (first) layer of the weft-knitted 3D-knitted spacer fabric of the invention and the first needle bed makes the bottom (third) layer of the weft-knitted 3D-knitted spacer fabric of the invention.

The processing to manufacture a 3D-knitted spacer fabric of the invention is similar to traditional 3D-knitted spacer fabric. Therefore, the overall cost is similarly low. The methods disclosed herein to manufacture the 3D-knitted spacer fabric of the invention do not require extra post chemical treatment or yarn covering process, which makes it much cheaper than the alternative methods described in Section 2 above.

6. Methods of Imparting a 3D Shape to the 3D Knitted Spacer Fabric 3D knitted spacer fabrics of the invention may be heat treated and set to impart a 3D shape to the fabric. Thermo-fuse fiber in the blended thermo-fuse yarn in the middle layer melts and recrystallizes during the heat treatment process. A 3D shape may be imparted to the fabric using a pin plate to hold the fabric during the heat treatment process. After this process, the thermo-fuse blended yarn becomes solid, supporting the fabric to have the designed thickness and giving the 3D spacer strong compression and rebound resilience. The heat-treated fabric retains the one-way moisture management function because of the hydrophilic fiber in the blended thermo-fuse yarn. The heat-treated fabric provides both one-way moisture management and a 3D shape.

Figure 2C:
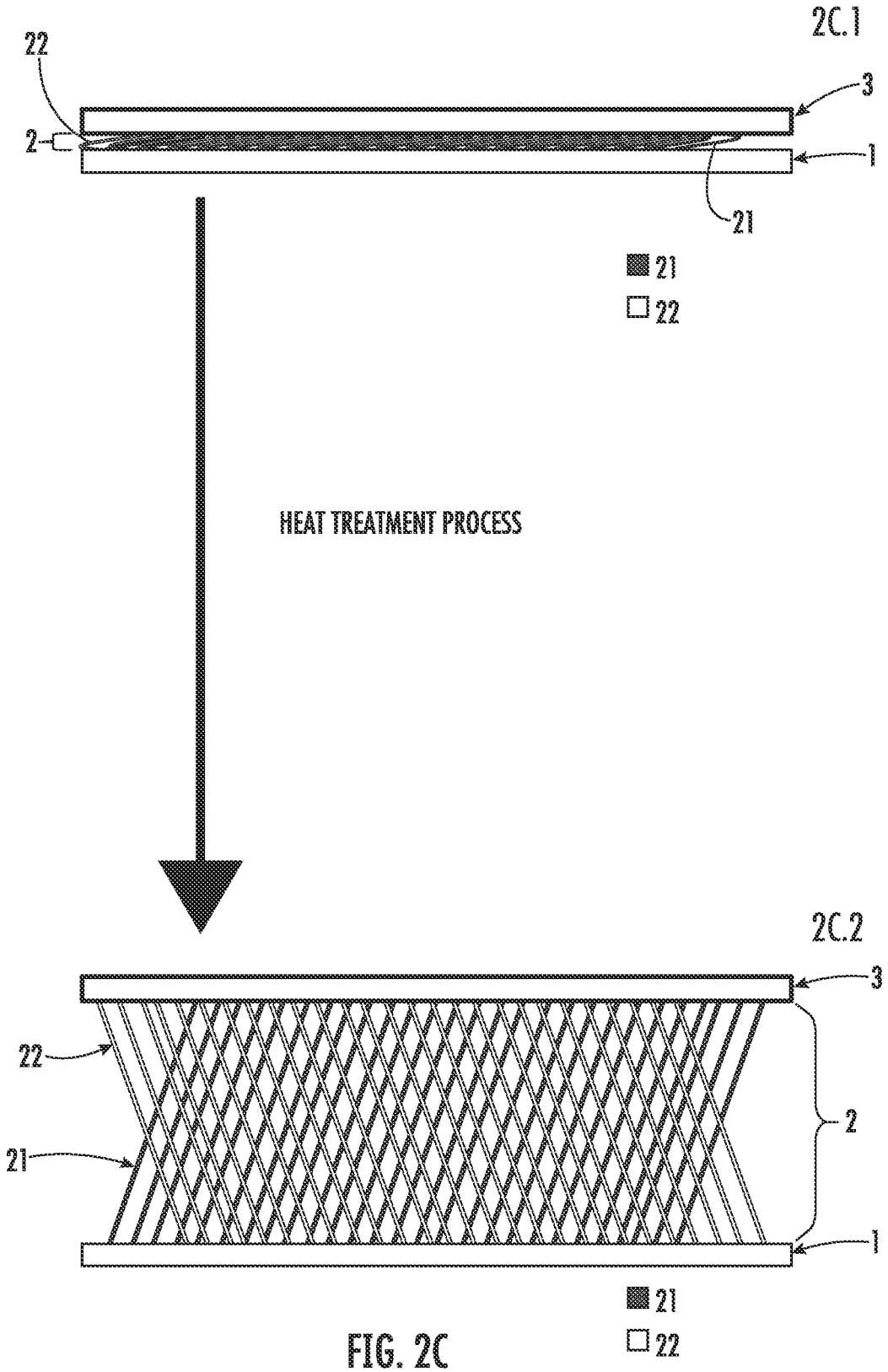

During the setting process after knitting, the thermo-fuse fiber will melt and recrystallize, reshape the blended yarn in filler layer from non-supportive to supportive, give the 3D spacer compression and rebound resilience, and retain the one-way moisture management function. FIG. 2C depicts an exemplary heat treatment process of 3D-knitted fabrics of the invention, showing the fabric before (FIG. 2C.1) and after (FIG. 2C.2) heat treatment and setting. Before heat treatment (FIG. 2C.1), the yarns of the middle layer are non-supportive and do not hold a 3D shape. After heat treatment (FIG. 2C.2), the yarns of the middle layer are supportive and hold a 3D shape. The change in thickness of the fabric in FIG. 2C after heat treatment is for illustration and is not limiting. The thickness of the fabric after heat treatment depends on the distance between the two needle beds during knitting process. That distance determines how long the middle layer yarn is between two surface layers because the middle layer yarn travels from one bed to the other to connect the two layers. The pin plate is used to hold the fabric and allows the middle layer to elongate to its longest extent by gravity.

Fabric may be heat set using a heat setting machine (e.g., Model LK 82811-2300HO, LK&LH Co., Ltd), with a pin plate. (e.g., Model LK 82811-10 mm pin plate, LK&LH Co., Ltd) to control the thickness of the shape. An exemplary heat-setting process is described in Example 4.

Blended thermo-fuse yarns are made of hydrophilic fiber and thermo-fuse fiber. Some blended thermo-fuse yarns have a core-shell structure made by a composite spinning method, where the core layer is made of hydrophilic polyester, and the shell layer is made of thermo-fuse polyester. In an example, the thermo-fuse polyester fiber in the blended thermo-fuse yarn has a melting point of about 180° C. In an example, the melting point for a hydrophilic polyester fiber in the blended thermo-fuse yarn is 250-265° C. Heat-setting of the fabrics of the invention may be performed at 180° C. Only the thermo-fuse fiber in the blended thermo-fuse yarn will melt and recrystallize to solidify the yarn in the fabric.

7. Exemplary Yarns Used in the Compositions

A hydrophilic yarn used as a first yarn in a middle layer can comprise natural fiber, a synthetic fiber, or an artificial fiber (also known as a semi-synthetic fiber). Exemplary natural fibers are cotton and wool. Exemplary synthetic fibers are nylon and modified polyester. An exemplary artificial fiber is viscose. The hydrophilic yarn used as a first yarn in the middle layer is a functional wicking yarn. The hydrophilic yarn used as a first yarn in the middle layer is non-supportive.

A blended thermo-fuse (heat-fusible) yarn used as a second yarn in a middle layer comprises hydrophilic fiber and thermo-fuse fiber. A hydrophilic fiber in a blended thermo-fuse (heat-fusible) yarn can be a natural fiber, a synthetic fiber, or an artificial fiber (also known as a semi-synthetic fiber). Exemplary natural fibers are cotton and wool. Exemplary synthetic fibers are nylon and modified polyester. An exemplary artificial fiber is viscose. A thermo-fuse (heat-fusible) fiber in a blended thermo-fuse (heat-fusible) yarn is a material with a low melting point, for example, a low-melting-point viscose, nylon, or polyester. An exemplary commercial blended thermo-fuse yarn has a core-shell structure made by a composite spinning method (XiangLu Chemical Fibers Co., Ltd, 450D Cat. No. 50020), where the core layer is made of hydrophilic polyester, and the shell layer is made of thermo-fuse polyester. The melting point for the thermo-fuse polyester fiber in the exemplary commercial blended thermo-fuse yarn is about 180° C. The melting point for the exemplary hydrophilic polyester fiber in the commercial blended thermo-fuse yarn is 250-265° C. The blended thermo-fuse wicking yarn is a functional wicking yarn (moisture-manageable). The blended thermo-fuse wicking yarn is non-supportive before heat treatment. After heat treatment, the blended thermo-fuse wicking yarn is supportive.

Hydrophilic yarn (also known as a moisture manageable yarn or a functional wicking yarn) used in a top layer can comprise a natural fiber, synthetic fiber, or an artificial fiber. Exemplary natural fibers are cotton and wool. Exemplary synthetic fibers are nylon and modified polyester. An exemplary artificial fiber is viscose.

Hydrophobic yarn used in a bottom layer can be a monofilament yarn, e.g., polyethylene terephthalate (PET), thermoplastic polyether ester elastomer (TPEE), polyamine (PA), thermoplastic polyurethane (TPU), polypropylene (PP), or polyethylene (PE), or a multifilament yarn, e.g., polyester, polyethylene, or polypropylene. Hydrophobic yarn used in a bottom layer is water-repellant.

8. Properties of the 3D-Knitted Spacer Fabrics 3D-knitted spacer fabrics with hydrophilic second layer may be tested for breathability by standard tests, for example by an ISO 11092 test (Example 5) and for moisture management by standard tests, for example by an AATCC TM195 test (Example 6) and by using an infrared camera to film how fast liquid water was transferred from one surface to the other side on the cross section (Example 7).

9. Uses of 3D-Knitted Spacer Fabric of the Invention

The 3D-knitted spacer fabric of the present invention are designed to absorb and wick body fluids such as sweat, urine, blood, and mucus. An article of manufacture, including an article of clothing comprising the 3D-knitted fabric is permeable to body fluids and comfortable for the user.

The 3D-knitted spacer fabric of the invention can be used in industrial, medical, and consumer products for moisture management, compression, and rebound resilience. The 3D-knitted spacer fabric of the invention is useful in products for individuals who work for extended periods in hot sun, under conditions of high solar radiation and/or high temperature. The 3D-knitted spacer fabric of the invention with its ability to form a desired 3D shape and moisture management properties provides moisture management and padding in products for individuals in high solar radiation and/or high temperature environment.

When the 3D-knitted spacer fabric of the invention is used as wearable equipment worn by workers, the liquid sweat will be absorbed by the yarn in the top face layer (first layer, next to human skin, for example skin of a human) and be wicked through all the yarn in the middle layer to the bottom face layer (third layer) immediately, which increases the liquid spreading area and accelerate sweat evaporation. Water vapor can also pass freely thought the 3D-knitted spacer fabric to the outside.

Compositions of the invention useful in providing moisture management, compression and rebound resistance to individuals in high solar radiation and/or high temperature environments. In an example, the individual is a utility worker, construction worker, or general industrial worker. The 3D-knitted spacer fabric of the invention may be used in personal protective equipment for industry. The 3D-knitted spacer fabric of the invention may be used in protective article of clothing, for example a safety harness, a fall protection harness, a safety helmet or hat, or a safety shoe.

An exemplary use is in a utility harness, for example a Honeywell Miller H700 Utility Harness (Honeywell Industrial Safety, Fort Mill, SC, USA). Some safety harnesses comprise a 3D-knitted spacer fabric of the invention in a padding. A safety helmet or hat may comprise the 3D-knitted spacer fabric with hydrophilic second layer in a helmet or hat cushion. A safety shoe may comprise the 3D-knitted spacer fabric of the invention in a safety shoe insole. Other exemplary uses are in consumer products (e.g., clothing, hats, vests, shoes) to provide cooling to individuals in high solar radiation environments and/or high temperature environments. Exemplary uses are in consumer products such as an elbow pad, kneepad, beekeeper suit, or sole of a shoe, or a hat. Exemplary uses are in sporting equipment, for example, in a kneepad, an elbow pad, a sports shoe, or a sole of sports shoe. Other exemplary uses are in furniture products, for example, a seat cushion, a back cushion, a mattress, a pillow, a table mat, or as a decorative layer in furniture. Other exemplary uses are in medical products for example a base fabric in a surgical dressing.

All patent filings, websites, other publications, and the like cited above or below are incorporated by reference in their entirety for all purposes to the same extent as if each individual item were specifically and individually indicated to be so incorporated by reference. The effective filing date means the earlier of the actual filing date or filing date of a priority application referring to the accession number if applicable. Likewise if different versions of a publication, website or the like are published at different times, the version most recently published at the effective filing date of the application is meant unless otherwise indicated. Any feature, step, element, embodiment, or aspect of the invention can be used in combination with any other unless specifically indicated otherwise. Although the present invention has been described in some detail by way of illustration and example for purposes of clarity and understanding, it will be apparent that certain changes and modifications may be practiced within the scope of the appended claims.

EXAMPLES

Example 1: Materials Used in Preparation of an Exemplary 3D-Knitted Spacer Fabric According to the Invention Exemplary materials used in preparation of an exemplary 3D-knitted spacer fabric according to the invention are described in Table 1.

TABLE 1

| Materials | | | |
|---|---|---|---|
| Material | Commercial Source | Material Specification | Catalog Number |
| blended thermo-fuse wicking yarn (used in middle layer) | XiangLu Chemical Fibers Co., Ltd | 450D core-shell structure made by composite spinning method, with core layer made of hydrophilic polyester, and shell layer made of thermo-fuse polyester | 50020 |
| non-supportive hydrophilic functional wicking yarn (used in middle layer) | Qingdao Xinwei Textile Development Co., Ltd | 150D/144F polyester DTY | NED13122SZ |
| hydrophilic yarn/moisture manageable yarn (used in top layer) | Qingdao Xinwei Textile Development Co., Ltd | 150D/144F polyester DTY | NED13122SZ |
| hydrophobic yarns (used in bottom layer | Yan Cheng City longtai Special Fiber Co., Ltd | 0.2 mm PET monofilament | PET0.2MM |

Example 2: Preparation of 3D-Knitted Spacer Fabric by Warp Knitting

A warp knitted 3D-Knitted Spacer Fabric is fabricated on a double needle bed warp knitting machine, for example a Karl Mayer (China) Ltd., Model No. HD6/20-35, with no less than two middle bars, which can work on the middle layer. One or more of the middle bars is threaded with a non-supportive hydrophilic functional wicking yarn, and the left middle bar(s) is threaded with a blended thermo-fuse wicking yarn. The knitting process is basically the same as normal warp knitting, with extra load adjustment on each yarn to make it knit smoothly, for example, using a MULTITENS motorical yarn tensioner system with individual-yarn control, by Karl Mayer Co., Ltd.

Example 3: Preparation of 3D Knitted Spacer Fabric by Weft Knitting

A weft-knitted 3D-Knitted Spacer Fabric is fabricated on a double needle bed weft knitting machine (including circular knitting machine and flat knitting machine). An exemplary weft-knitting machine is a Stoll Machine (China) Co., CMS 350. A traditional middle layer is knitted by one single supportive yarn at a time. The knitting process is basically the same as normal weft knitting, however with multiple yarns for the middle layer and fed together at the same time and with extra load adjustment equipment on each yarn of the second layer to make it knit smoothly, for example, using a MULTITENS motorical yarn tensioner system with individual-yarn control, by Karl Mayer Co., Ltd.

Example 4: Heat Treatment of 3D Knitted Spacer Fabric to Set the Fabric into a 3D Shape The heat setting process is similar to a traditional setting process, and uses a pin plate to control the thickness of the shape.

TABLE 2

| Equipment for Heat Setting Process | | |
|---|---|---|
| | commercial source | model numbers |
| heat-setting machine | LK&LH Co., Ltd | LK 828II-2300HO |
| clamps | LK&LH Co., Ltd | LK 828II-10 mm pin plate |

1. First, heat set the top surface layer. The pin plate holds only the edge of the top surface layer, which faces up, and allows the middle layer to elongate by gravity. Hot air blows down from the upper jet-nozzle above the fabric, and blows up from the lower jet-nozzle below the fabric, to heat it up and let the blended thermo-fuse wicking yarn to melt. Then, cool down the fabric at room temperature till the blended thermo-fuse wicking yarn is recrystallized to solid status.
2. Second, heat set the bottom surface. This time the bottom surface layer faces up. The pin plate holds only the edge of the bottom surface layer, which faces up, and allows the middle layer to elongate by gravity. Hot air blows down from the upper jet-nozzle above the fabric and blows up from the lower jet-nozzle below the fabric, to heat it up and let the blended thermo-fuse wicking yarn to melt. Then, cool down the fabric at room temperature till the blended thermo-fuse wicking yarn is recrystallized to solid status.
3. Finally, the solid middle layer can maintain the thickness and support the 3D shape of the spacer fabric.

Example 5: Testing Breathability of 3D-Knitted Spacer Fabric

ISO 11092: Textiles—Physiological effects—Measurement of thermal and water-vapor resistance under steady-state conditions (sweating guarded-hotplate test)

Breathability is tested by this standard method. The lower R et (water-vapor resistance) is, the more water is evaporated through the fabric and more heat is taken away, the better thermal comfort the fabric will provide.

Example 6: Measuring Liquid Transfer in 3D-Knitted Spacer Fabric by AATCC TM195 Test AATCC TM195: Liquid Moisture Management Properties of Textile Fabrics Moisture management is tested by this standard method. Exemplary equipment for the test is an SDLATLAS M290 Moisture Management Tester.

1. Record the wetting time of two surfaces begin to be wetted after the test is started.
2. Calculate the time for liquid to transfer through the middle layer from one side to the other.

Example 7: Measuring Liquid Transfer in 3D-Knitted Spacer Fabric by Infrared Camera Test Moisture management is tested by this standard method. Use an infrared camera to film how fast liquid water is transferred from one surface to the other side on the cross section.

What is claimed is:

1. A three-dimensional (3D)-knitted spacer fabric, the 3D-knitted spacer fabric comprising a top layer, a bottom layer, and an intermediate layer, wherein the top layer and the bottom layer are joined together by cross-yarns constituting the intermediate layer, wherein the intermediate layer comprises a first yarn and a second yarn, wherein the first yarn is a first hydrophilic yarn and the second yarn is a blended heat-fusible yarn, comprising a hydrophilic fiber and a heat-fusible fiber.

2. The 3D-knitted spacer fabric of claim 1, wherein the top layer comprises a second hydrophilic yarn.

3. The 3D-knitted spacer fabric of claim 1, wherein the bottom layer comprises a hydrophobic yarn.

4. The 3D-knitted spacer fabric of claim 1, wherein the 3D-knitted spacer fabric is a warp-knitted 3D-knitted spacer fabric or a weft-knitted 3D-knitted spacer fabric.

5. The 3D-knitted spacer fabric of claim 1, wherein the blended heat-fusible yarn is fused by heat treatment to impart a 3D shape to the 3D-knitted spacer fabric.

6. The 3D-knitted spacer fabric of claim 1, wherein the blended heat-fusible yarn comprises a core layer of hydrophilic polyester and a shell layer of thermo-fuse polyester.

7. The 3D-knitted spacer fabric of claim 1, wherein the second hydrophilic yarn is polyester; the first hydrophilic yarn is polyester, the blended heat-fusible yarn comprises a core layer of hydrophilic polyester and a shell layer of thermo-fuse polyester, and the hydrophobic yarn is PET monofilament.

8. A method for manufacturing a three-dimensional (3D)-knitted spacer fabric, the 3D-knitted spacer fabric being manufactured on a double-bed knitting machine, wherein the method comprises simultaneously knitting a top layer, a bottom layer and an intermediate layer for providing a connection between the top layer and the bottom layer, the intermediate layer comprising cross-yarn configured for providing a resilient connection between the top layer and the bottom layer, wherein the intermediate layer is knitted from a first yarn and a second yarn, wherein the first yarn is a first hydrophilic yarn and the second yarn is a blended heat-fusible yarn, comprising a hydrophilic fiber and a heat-fusible fiber.

9. The method of claim 8, wherein the top layer is knitted from a second hydrophilic yarn.

10. The method of claim 8, wherein the bottom layer is knitted from a hydrophobic yarn.

11. The method of claim 8, wherein the 3D-knitted spacer fabric is a warp knitted 3D-knitted spacer fabric or a weft-knitted 3D-knitted spacer fabric.

12. The method of claim 8, further comprising heating the 3D-knitted spacer fabric, setting the heated 3D-knitted spacer fabric to a 3D shape, and cooling the set 3D-knitted spacer fabric to impart the 3D shape to the 3D-knitted spacer fabric.

13. The method of claim 8, wherein the heat fusible fiber in the blended heat-fusible yarn is low-melting-point viscose, nylon, or polyester.

14. The method of claim 8, wherein the blended heat-fusible yarn comprises a core layer of hydrophilic polyester and a shell layer of thermo-fuse polyester.

15. The method of claim 8, wherein the second hydrophilic yarn is polyester; the first hydrophilic yarn is polyester, the blended heat-fusible yarn comprises a core layer of hydrophilic polyester and a shell layer of thermo-fuse polyester, and the hydrophobic yarn is PET monofilament.

16. An article of manufacture comprising the 3D-knitted spacer fabric of claim 1.

17. The article of manufacture of claim 16, wherein the article of manufacture is a safety harness.

18. The article of manufacture of claim 17, wherein the safety harness comprises a padding.

19. The article of manufacture of claim 18, wherein the padding comprises the 3D-knitted spacer fabric.

20. A method for absorbing sweat using the 3D-knitted spacer fabric of claim 1.

* * * * *